US006810602B2

(12) United States Patent
Kim et al.

(10) Patent No.: US 6,810,602 B2
(45) Date of Patent: Nov. 2, 2004

(54) DRIER MODULE

(75) Inventors: Sang Doo Kim, Changwon-si (KR); Jae Suk Yang, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/718,029

(22) Filed: Nov. 21, 2003

(65) Prior Publication Data

US 2004/0168345 A1 Sep. 2, 2004

(30) Foreign Application Priority Data

Nov. 26, 2002 (KR) ..... 10-2002-0074083

(51) Int. Cl.[7] ..... F26B 21/00

(52) U.S. Cl. ..... 34/547; 34/543; 34/535; 34/539

(58) Field of Search ..... 34/260, 423, 425, 34/549, 553, 596, 202, 132, 134, 234, 547, 543, 535, 539, 531, 527; 392/307; 219/476, 477, 478

(56) References Cited

U.S. PATENT DOCUMENTS 3,157,390 A * 11/1964 Douglas ..... 392/310
3,860,786 A * 1/1975 Wass ..... 392/307
4,783,908 A * 11/1988 Pabst ..... 34/273

* cited by examiner

*Primary Examiner*—Kenneth Rinehart
(74) *Attorney, Agent, or Firm*—McKenna Long & Aldridge LLP

(57) ABSTRACT

A drier module, for use in a drier having a drier motor and one of two heat generation devices, namely gas or electric, is an interchange module of a drier of a gas or electric type and may be connected to a drier motor and to a gas control circuit of a gas drier or to an electric heater of an electric drier. During drier assembly, the module is adaptively modified, for example, by setting a switch position according to a desired mode, i.e., the intended drier type. The module includes a selection switch for selecting one of a gas mode and an electric mode; a first connector providing a connection to the drier motor and to a first heat generation device; a second connector providing a connection to the first heat generation device and to a second heat generation device; a microprocessor, electrically connected to the first and second connectors, for detecting a presence of an error condition with respect to the selected mode of the selection switch, based on the connections of the first and second connectors; a first relay, electrically connected between the microprocessor and first connector, for controlling power to the drier motor; a second relay, electrically connected between the microprocessor and first connector, for controlling power to the one of the two heat generation devices; a power supply for providing, under control of the microcomputer, operational power for the drier motor and first and second heat generation devices; and a display for displaying a message indicating the presence of the error condition.

15 Claims, 1 Drawing Sheet

DRIER MODULE

This application claims the benefit of Korean Application No. 10-2002-0074083 filed on Nov. 26, 2002, which is hereby incorporated by reference.

BACKGROUND OF THE INVENTION

1. Field of the Invention

The present invention relates to a drier module, and more particularly, to an interchangeable module of a drier of a gas or electric type.

2. Discussion of the Related Art

Generally speaking, a drier uses an energy source, such as gas or electricity, to heat air. That is, driers are generally categorized according to the energy used for drying an object, e.g., laundry, with the gas drier using gas to generate heat and the electric drier using current to generate heat. Thus, a gas drier and an electric drier are fundamentally the same, and due to this similarity, both types may be assembled on the same production line.

The connection of a circuit module for drier control, however, differs with respect to module location and structure depending on the drier type. Accordingly, a distinct printed circuit board is used for assembly in each case, i.e., an electric drier PCB or a gas drier PCB, which increases the overall costs of manufacturing the product and may even necessitate entirely separate assembly lines.

SUMMARY OF THE INVENTION

Accordingly, the present invention is directed to a drier module that substantially obviates one or more of the problems due to limitations and disadvantages of the related art.

An object of the present invention, which has been devised to solve the foregoing problem, lies in providing a drier module which is appropriate for use commonly in either a gas drier or an electric drier.

In is another object of the present invention to provide a drier module which enables the manufacture of gas and electric driers at a reduced cost.

In is another object of the present invention to provide a drier module which enables the manufacture of gas and electric driers on the same production line.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a drier module for use in a drier having a drier motor and one of two heat generation means. The module comprises a selection switch for selecting one of a gas mode and an electric mode; a first connector providing a connection to the drier motor and to a first heat generation means; a second connector providing a connection to the first heat generation means and to a second heat generation means; and a microprocessor, electrically connected to the first and second connectors, for detecting a presence of an error condition with respect to the selected mode of the selection switch, based on the connections of the first and second connectors.

Preferably, the drier module of the present invention includes a first relay, electrically connected between the microprocessor and first connector, for controlling power to the drier motor; a second relay, electrically connected between the microprocessor and first connector, for controlling power to the one of the two heat generation means; a power supply for providing, under control of the microcomputer, operational power for the drier motor and first and second heat generation means; and a display for displaying a message indicating the presence of the error condition.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Figure 1:
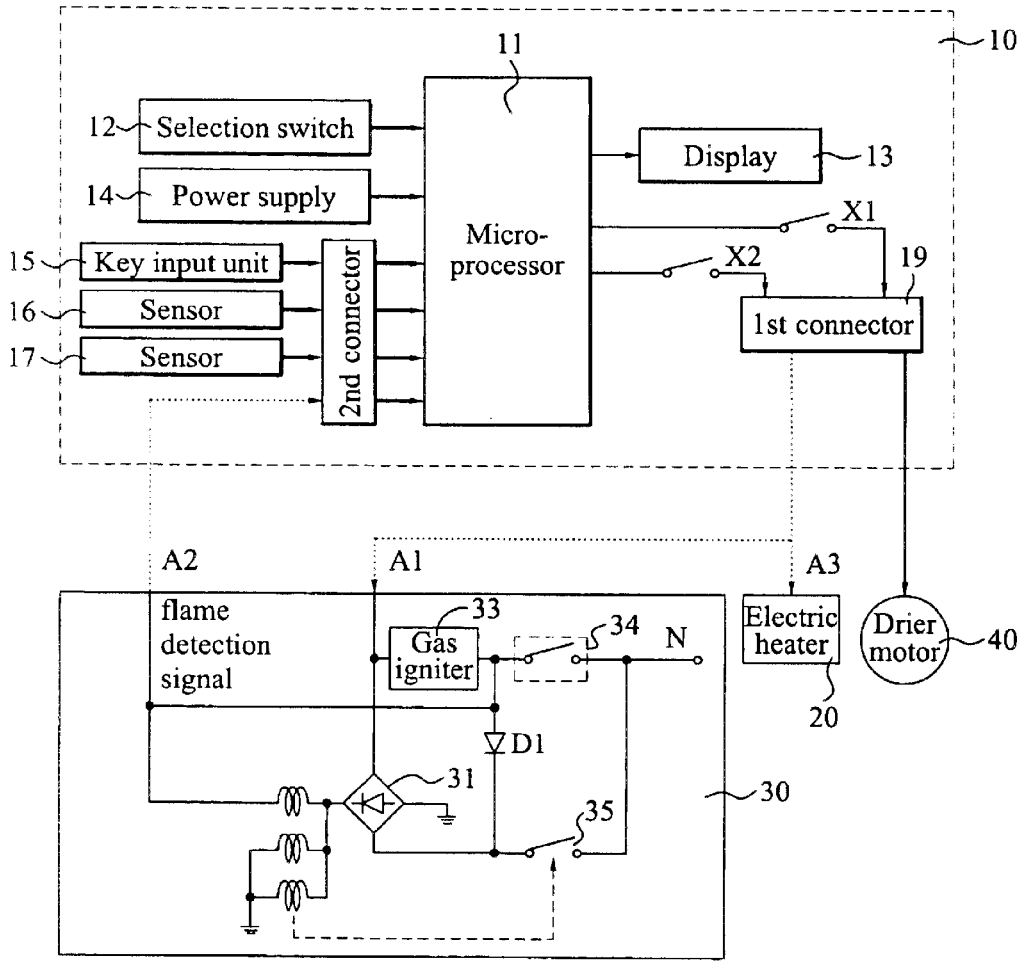
FIG. 1 is a circuit diagram of a drier module according to the present invention, showing potential interconnections for a gas drier and for an electric drier.

Reference will now be made in detail to the preferred embodiment of the present invention, examples of which are illustrated in the accompanying drawings. Throughout the drawings, like elements are indicated using the same or similar reference designations where possible.

Referring to FIG. 1, a drier module 10 according to the present invention is provided separately from the drier motor and one of two heat generation means. Here, the heat generation means may include either an electric heater or a gas control circuit but not both. According to the present invention, the drier module 10 is an interchange module of a drier of a gas or electric type and may be connected to a drier motor 40 and to a gas control circuit 30 of a gas drier (not shown) or to an electric heater 20 of an electric drier (not shown). During drier assembly, the module is adaptively modified, for example, by setting a switch position according to a desired mode, i.e., the intended drier type.

The drier module 10 according to the present invention includes a selection switch 12 having a manual setting means (not shown) for selecting either a gas mode or an electric mode; a first connector 19 providing a connection primarily to the drier motor and selectively to a first heat generation means, i.e., the electric heater 20; a second connector providing a connection selectively to a second heat generation means, i.e., the gas control circuit 30; a microprocessor 11, electrically connected to the first and second connectors, for detecting the presence of an error condition with respect to the selected mode of the selection switch during drier assembly or use, based on the connections of the first and second connectors, that is, when the electric heater is connected to the first connector or when the gas control circuit is connected to the first or second connectors, and for routing power from a power supply 14 for providing an operational power for each of a plurality of drier components, specifically including the drier motor, electric heater, and gas control circuit; and a display 13 for displaying an operational status and specifically for displaying a message indicating the presence of the error condition. First and second relays X1 and X2 are respectively provided between the microprocessor 11 and first connector 19. The first relay X1 controls power to the electric heater 20 or the gas control circuit 30, and the second relay X2 controls power to the drier motor 40. The microprocessor 11 receives inputs via the second connector 18, including a key input of a key input unit 15 and sensor signals from a plurality of sensors 16 and 17 for sensing the functional status of the drier. In the gas mode, the microprocessor 11 also receives a flame detection signal from the gas control circuit 30 via a connection line A2.

In selecting the electric mode, the microprocessor 11 powers the electric heater 20 by applying the power of the power supply 14 to the first connector 19 through the second relay X2 and a connection line A3. In selecting the gas mode, on the other hand, the microprocessor 11 powers a gas igniter 33 by applying the power of the power supply 14 to the first connector 19 through the second relay X2 and a connection line A1, which is the main power line of the gas control circuit 30 with respect to a neutral terminal N. In doing so, the power on the connection line A1 travels at the time of gas ignition via a rectifying diode D1, anode to cathode, to a relay switch 35 and a bridge diode 31 for providing power to a plurality of relay coils to control a set of gas valves and the like.

In assembling the drier module according to the present invention, a setting of the selection switch 12 for the electric mode allows for the connection of the electric heater 20 and drier motor 40 via the first connector 19, with the second connector 18 connected to the key input unit 15 and the plurality of sensors 16 and 17. In doing so, the connection line A2 of the gas control circuit 30 is unused. Meanwhile, a setting of the selection switch 12 for the gas mode allows for the connection of the gas control circuit 30 and drier motor 40 via the first and second connectors 18 and 19.

The above-described embodiment of the present invention may be modified according to drier model and other factors. The assembly of a drier adopting the module of the present invention, however, includes such a module regardless of the embodiment, with either the gas control circuit 30 or electric heater 20 being assembled thereto as necessary. A setting of the selection switch 12 is determined based on whether the drier to be assembled is a gas drier or an electric drier.

Notably, in using or assembling a gas drier having a drier module set to the electric mode, the microprocessor 11 recognizes the selected mode of the selection switch 12, so that a warning may be displayed by the display 13 and so that the microprocessor may otherwise disable operation. Conversely, though the aforementioned condition is the more hazardous, a similar display and disabling conditions may be generated for the use or assembly of an electric drier having a drier module set to the gas mode.

By adopting the drier module of the present invention, which includes both gas and electric modes, a gas drier and an electric drier can be assembled on the same production line, reducing the overall costs to manufacture a drier accordingly. The present invention also enables the detection and warning of an improper installation of a gas control circuit, which may occur due to an incorrect assembly or user misuse, thereby minimizing the occurrence of assembly errors and user accidents.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A drier module for use in a drier having a drier motor and one of two heat generation means, the module comprising:

a selection switch for selecting one of a gas mode and an electric mode;

a first connector providing a connection to the drier motor and to a first heat generation means;

a second connector providing a connection to the first heat generation means and to a second heat generation means; and a microprocessor, electrically connected to said first and second connectors, for detecting a presence of an error condition with respect to the selected mode of said selection switch, based on the connections of said first and second connectors.

2. The module as claimed in claim 1, further comprising:

a first relay, electrically connected between said microprocessor and first connector, for controlling power to the drier motor; and a second relay, electrically connected between said microprocessor and first connector, for controlling power to the one of the two heat generation means.

3. The module as claimed in claim 1, wherein the first heat generation means includes a gas control circuit.

4. The module as claimed in claim 1, wherein the second heat generation means is an electric heater.

5. The module as claimed in claim 1, further comprising a power supply for providing, under control of said microcomputer, operational power for the drier motor and first and second heat generation means.

6. The module as claimed in claim 1, further comprising a display for displaying a message indicating the presence of the error condition.

7. The module as claimed in claim 1, wherein the presence of the error condition is detected during an assembly stage of the drier.

8. The module as claimed in claim 1, wherein the presence of the error condition is detected during a usage of the drier.

9. The module as claimed in claim 8, wherein said microcomputer is disabled when the presence of the error condition is detected.

10. The module as claimed in claim 1, wherein said selection switch includes manual setting means for modifying the module according to an assembly state of the drier.

11. The module as claimed in claim 10, wherein the manual setting means is set for the electric mode.

12. The module as claimed in claim 10, wherein the manual setting means is set for the gas mode.

13. The module as claimed in claim 12, wherein said microcomputer receives via said second connector a flame detection signal from the second heat generation means.

14. The module as claimed in claim 1, wherein one of the two heat generation means uses an energy source of gas and the other uses an energy source of electricity.

15. The module as claimed in claim 1, wherein the drier is a laundry drier.

* * * * *